US010240228B2

(12) United States Patent
Terlinde et al.

(10) Patent No.: US 10,240,228 B2
(45) Date of Patent: Mar. 26, 2019

(54) HEAT-RESISTANT AL—CU—MG—AG ALLOY AND PROCESS FOR PRODUCING A SEMIFINISHED PART OR PRODUCT COMPOSED OF SUCH AN ALUMINUM ALLOY

(75) Inventors: Gregor Terlinde, Meinerzhagen (DE); Thomas Witulski, Meinerzhagen (DE); Matthias Hilpert, Meinerzhagen (DE)

(73) Assignee: Otto Fuchs KG, Meinerzhagen (DE)

( * ) Notice: Subject to any disclaimer, the term of this patent is extended or adjusted under 35 U.S.C. 154(b) by 174 days.

(21) Appl. No.: 14/234,981

(22) PCT Filed: Aug. 1, 2012

(86) PCT No.: PCT/EP2012/064982

§ 371 (c)(1),
(2), (4) Date: Jan. 24, 2014

(87) PCT Pub. No.: WO2013/023907

PCT Pub. Date: Feb. 21, 2013

(65) Prior Publication Data

US 2014/0166161 A1 Jun. 19, 2014

(30) Foreign Application Priority Data

Aug. 17, 2011 (EP) ..... 11177747

(51) Int. Cl.
*C22C 21/00* (2006.01)
*C22C 21/14* (2006.01)
(Continued)

(52) U.S. Cl.
CPC ..... *C22F 1/057* (2013.01); *B22D 7/005* (2013.01); *B22D 27/00* (2013.01); *C21D 1/60* (2013.01);
(Continued)

(58) Field of Classification Search
CPC ..... C22F 1/057; C22C 21/00; C22C 21/14; C22C 21/16; C21D 1/60
See application file for complete search history.

(56) References Cited

U.S. PATENT DOCUMENTS 3,475,166 A 10/1969 Raffin
6,146,477 A * 11/2000 Clark ..... B22D 13/00 148/539
(Continued)

FOREIGN PATENT DOCUMENTS

CN 1829812 A 9/2006
EP 1518000 A1 3/2005
(Continued)

OTHER PUBLICATIONS

Written Opinion of the International Searching authority for International application No. PCT/EP2012/064982, entire document.
(Continued)

*Primary Examiner* — Keith Walker
*Assistant Examiner* — John A Hevey
(74) *Attorney, Agent, or Firm* — Polson Intellectual Property Law, PC; Margaret Polson; Christopher Sylvain

(57) ABSTRACT

A heat-resistant Al—Cu—Mg—Ag alloy for producing semi-finished parts or products, which is suitable for use at elevated temperatures and has good static and dynamic strength properties combined with an improved creep resistance and comprises: 0.3-0.7% by weight of silicon (Si), not more than 0.15% by weight of iron (Fe), 3.5-4.7% by weight of copper (Cu), 0.05-0.5% by weight of manganese (Mn), 0.3-0.9% by weight magnesium (Mg), 0.02-0.15% by weight of titanium (Ti), 0.03-0.25% by weight of zirconium (Zr), 0.1-0.7% by weight of silver (Ag), 0.03-0.5% by weight of scandium (Sc), 0.03-0.2% by weight of vanadium (V), not more than 0.05% by weight of others, individually, not more than 0.15% by weight of others, total, balance
(Continued)

| Alloy | % Si | % Fe | % Cu | % Mn | % Mg | % Cr | % Ni | % Zn |
|---|---|---|---|---|---|---|---|---|
| 2014 | 0,50 - 1,2 | ≤ 0,7 | 3,9 - 5,0 | 0,40 - 1,2 | 0,20 - 0,8 | ≤ 0,10 | - | ≤ 0,25 |
| 2014 A | 0,50 - 0,9 | ≤ 0,50 | 3,9 - 5,0 | 0,40 - 1,2 | 0,20 - 0,8 | ≤ 0,10 | ≤ 0,10 | ≤ 0,25 |
| 2214 | 0,50 - 0,9 | ≤ 0,30 | 3,9 - 5,0 | 0,40 - 1,2 | 0,20 - 0,8 | ≤ 0,10 | - | ≤ 0,25 |
| 2618 | 0,10 - 0,25 | 0,9 - 1,3 | 1,9 - 2,7 | - | 1,3 - 1,8 | - | 0,9 - 1,2 | ≤ 0,10 |
| 2618 A | 0,15 - 0,25 | 0,9 - 1,4 | 1,8 - 2,7 | ≤ 0,25 | 1,2 - 1,8 | - | 0,8 - 1,4 | ≤ 0,15 |
| 2016 | 0,30 - 0,7 | ≤ 0,15 | 3,5 - 4,5 | 0,10 - 0,50 | 0,30 - 0,80 | - | - | – |
| W | 0,3 - 0,7 | ≤ 0,15 | 3,5 - 4,7 | 0,05 - 0,5 | 0,3 - 0,9 | - | - | – |

| Alloy | % Zn | % Ti | % V | % Ag | % Sc | % Zr | % B | % Others Individual | % Others Total | Al |
|---|---|---|---|---|---|---|---|---|---|---|
| 2014 | ≤ 0,25 | ≤ 0,15 | - | - | - | 2) | - | ≤ 0,05 | ≤ 0,15 | remainder |
| 2014 A | ≤ 0,25 | ≤ 0,15 | - | - | - | ≤ 0,20 Ti + Zr | - | ≤ 0,05 | ≤ 0,15 | remainder |
| 2214 | ≤ 0,25 | ≤ 0,15 | - | - | - | 2) | - | ≤ 0,05 | ≤ 0,15 | remainder |
| 2618 | ≤ 0,10 | 0,04 - 0,10 | - | - | - | - | - | ≤ 0,05 | ≤ 0,15 | remainder |
| 2618 A | ≤ 0,15 | ≤ 0,20 | - | - | - | ≤ 0,25 Ti+Zr | - | ≤ 0,05 | ≤ 0,15 | remainder |
| 2016 | – | 0,05 - 0,15 | - | 0,30 - 0,7 | - | 0,10 - 0,25 | - | ≤ 0,05 | ≤ 0,15 | remainder |
| W | – | 0,02 - 0,15 | 0,05 - 0,2 | 0,1 - 0,7 | 0,03 - 0,5 | 0,03 - 0,25 | - | ≤ 0,05 | ≤ 0,15 | remainder |

aluminum, is described. A process for producing a semi-finished part or product composed of the above-mentioned aluminum alloy is described.

9 Claims, 3 Drawing Sheets

(51) Int. Cl.

| | |
|---|---|
| ***C22C 21/16*** | (2006.01) |
| ***C22F 1/057*** | (2006.01) |
| ***B22D 7/00*** | (2006.01) |
| ***C21D 1/60*** | (2006.01) |
| ***B22D 27/00*** | (2006.01) |

(52) U.S. Cl.
CPC ..... *C22C 21/00* (2013.01); *C22C 21/14* (2013.01); *C22C 21/16* (2013.01)

(56) References Cited

U.S. PATENT DOCUMENTS

| | | | |
|---|---|---|---|
| 7,214,279 | B2 | 5/2007 | Fischer et al. |
| 2005/0084408 | A1 | 4/2005 | Cho |
| 2005/0115645 | A1 | 6/2005 | Fischer et al. |
| 2008/0029187 | A1 | 2/2008 | Lin |

FOREIGN PATENT DOCUMENTS

| | | | | | |
|---|---|---|---|---|---|
| GB | 1320271 | A | | 6/1973 | |
| JP | 03107440 | | * | 5/1991 | ..... C22C 21/12 |
| JP | 03107440 | A | | 5/1991 | |
| JP | 03107440 | | | 7/1991 | |
| WO | WO-9610099 | A1 | * | 4/1996 | ..... C22C 21/003 |
| WO | 2004003244 | A1 | | 1/2004 | |
| WO | 2004111282 | A1 | | 12/2004 | |
| WO | WO2008003503 | | * | 1/2008 | ..... C22F 1/057 |

OTHER PUBLICATIONS

International Preliminary Report on Patentability for International application No. PCT/EP2012/064982, entire document.

International Search Report for International application No. PCT/EP2012/064982, entire document.

Office Action in related application CN 201280040155.7 dated May 4, 2015.

Examination Report dated Jul. 31, 2018 in related Canadian application 2843325.

* cited by examiner

| Alloy | % Si | % Fe | % Cu | % Mn | % Mg | % Cr | % Ni | % Zn |
|---|---|---|---|---|---|---|---|---|
| 2014 | 0,50 - 1,2 | ≤ 0,7 | 3,9 - 5,0 | 0,40 - 1,2 | 0,20 - 0,8 | ≤ 0,10 | - | ≤ 0,25 |
| 2014 A | 0,50 - 0,9 | ≤ 0,50 | 3,9 - 5,0 | 0,40 - 1,2 | 0,20 - 0,8 | ≤ 0,10 | ≤ 0,10 | ≤ 0,25 |
| 2214 | 0,50 - 0,9 | ≤ 0,30 | 3,9 - 5,0 | 0,40 - 1,2 | 0,20 - 0,8 | ≤ 0,10 | - | ≤ 0,25 |
| 2618 | 0,10 - 0,25 | 0,9 - 1,3 | 1,9 - 2,7 | - | 1,3 - 1,8 | - | 0,9 - 1,2 | ≤ 0,10 |
| 2618 A | 0,15 - 0,25 | 0,9 - 1,4 | 1,8 - 2,7 | ≤ 0,25 | 1,2 - 1,8 | - | 0,8 - 1,4 | ≤ 0,15 |
| 2016 | 0,30 - 0,7 | ≤ 0,15 | 3,5 - 4,5 | 0,10 - 0,50 | 0,30 - 0,80 | - | - | — |
| W | 0,3 - 0,7 | ≤ 0,15 | 3,5 - 4,7 | 0,05 - 0,5 | 0,3 - 0,9 | - | - | — |

| Alloy | % Zn | % Ti | % V | % Ag | % Sc | % Zr | % B | % Others | | Al |
|---|---|---|---|---|---|---|---|---|---|---|
| | | | | | | | | individual | Total | |
| 2014 | ≤ 0,25 | ≤ 0,15 | - | - | - | 2) | - | ≤ 0,05 | ≤ 0,15 | remainder |
| 2014 A | ≤ 0,25 | ≤ 0,15 | - | - | - | ≤ 0,20 Ti + Zr | - | ≤ 0,05 | ≤ 0,15 | remainder |
| 2214 | ≤ 0,25 | ≤ 0,15 | - | - | - | 2) | - | ≤ 0,05 | ≤ 0,15 | remainder |
| 2618 | ≤ 0,10 | 0,04 - 0,10 | - | - | - | - | - | ≤ 0,05 | ≤ 0,15 | remainder |
| 2618 A | ≤ 0,15 | ≤ 0,20 | - | - | - | ≤ 0,25 Ti+Zr | - | ≤ 0,05 | ≤ 0,15 | remainder |
| 2016 | — | 0,05 - 0,15 | - | 0,30 - 0,7 | - | 0,10 - 0,25 | - | ≤ 0,05 | ≤ 0,15 | remainder |
| W | — | 0,02 - 0,15 | 0,05 - 0,2 | 0,1 - 0,7 | 0,03 - 0,5 | 0,03 - 0,25 | - | ≤ 0,05 | ≤ 0,15 | remainder |

*Fig. 1*

HEAT-RESISTANT AL—CU—MG—AG ALLOY AND PROCESS FOR PRODUCING A SEMIFINISHED PART OR PRODUCT COMPOSED OF SUCH AN ALUMINUM ALLOY

BACKGROUND

The invention relates to a heat-resistant Al—Cu—Mg—Ag alloy for producing semi-finished parts or products, suitable for use at rather high temperatures and with high static and dynamic strength properties combined with an improved creep resistance. The invention also relates to a process for producing a semi-finished part or product composed of such an aluminum alloy.

An alloy of the above-cited type is known in EP 1 518 000 B1 from which semi-finished parts are produced with high static and dynamic strength properties, and an improved creep resistance in comparison to previously-known, similar aluminum alloys. This alloy is registered with the Aluminum Association (AA) as alloy AA2016. This previously-known alloy already approximately unites the strength properties necessary for semi-finished parts and products that must resist high static and dynamic loads. These properties are known from the alloys AA2014, AA 2014A or AA2214 and have an improved creep resistance, which is an improved resistance under the action of temperature. The alloy AA2016 therefore satisfies the claims put on semi-finished parts and products produced from them that are exposed for a short time to elevated temperatures, for example as in the wheel halves of airplanes. These semi-finished products are exposed to elevated temperatures only during braking after the airplane sets down on the landing strip.

The alloys AA2618 and AA2618A are considered to be especially creep-resistant. However, semi-finished parts and products produced from these alloys have only relatively low static and dynamic strength values.

The alloys for producing semi-finished parts with high static and dynamic strength properties in accordance with AA2014, AA2014A and AA2214 differ chemically from the alloys with long-time thermal stability according to AA2618 and AA2618A. This is because the very strong aluminum alloys contain relatively high amounts of the elements silicon, copper and manganese and relatively low amounts of the elements magnesium and iron, whereas the long-time thermally stable aluminum alloys have a reduced amount of silicon, copper and manganese in contrast to the above and an elevated content of iron, nickel and magnesium. In addition, nickel is mixed into the long-time thermally stable alloys.

The alloy AA2016 differs from the previously described alloys in particular by an admixture of the element silver with amounts between 0.30 and 0.7 wt %. There are also differences in the remaining alloy elements in comparison to the composition of both the previously-cited very strong aluminum alloys, and the previously-cited aluminum alloys whose semi-finished parts have a good creep resistance.

Even if the aluminum alloy AA2016 is known to produce semi-finished parts and products that can satisfy high static and dynamic strength requirements and also resist elevated temperatures in short-time use, there has long been a desire to have available an aluminum alloy for producing semi-finished parts and products that resist elevated temperatures for longer-term use. Such requirements are placed on a plurality of products, for example, on the compressor wheels of a turbocharger in motor vehicle engine uses. These structural components must not only resist high static and dynamic loads, but also the high temperatures prevailing in such a use for the duration of the use. Similar requirements for long-time stability at rather high temperatures are also applicable to turbocharger compressors of large engines in ship construction.

SUMMARY

The present invention provides an alloy from which a semi-finished part or a product can be produced that satisfies the desired properties for static and dynamic strength as well as long-time stability under high temperature.

This is accomplished by a heat-resistant Al—Cu—Mg—Ag alloy for producing semi-finished parts or products, suitable for use at rather high temperatures, with high static and dynamic properties of strength in combination with an improved creep resistance, containing:

0.3-0.7 wt % silicon (Si)
max. 0.15 wt % iron (Fe)
3.5-4.7 wt % copper (Cu)
0.05-0.5 wt % manganese (Mn)
0.3-0.9 wt % magnesium (Mg)
0.02-0.15 wt % titanium (Ti)
0.03-0.25 wt % zirconium (Zr)
0.1-0.7 wt % silver (Ag)
0.03-0.5 wt % scandium (Sc)
0.03-0.2 wt % vanadium (V)
max. 0.05 wt % others, individually
max. 0.15 wt % others, total
remainder aluminum.

This alloy has the elements scandium and vanadium in the cited amounts in particular. It is attributed to the interaction of these elements, together with the elements titanium and zirconium on the one hand and to the silver contained in the alloy on the other hand, that a semi-finished part produced from this alloy and accordingly the end product have sufficiently high static and dynamic strength properties as well as an especially good creep resistance. The strength properties may be slightly reduced in comparison to those of semi-finished parts from an aluminum alloy AA2016, but are clearly increased in comparison to such semi-finished parts produced from the alloy AA2618. These special properties of a semi-finished part produced from such an aluminum alloy were not to be expected. Therefore, this alloy is suitable for producing semi-finished parts and products that not only have to satisfy high static and dynamic strengths, but also must have a long-time stability under thermal influences, and therefore can have an excellent resistance to creep.

In one embodiment, the alloy contains 0.08 to 0.2 wt % scandium and 0.10 to 0.2 wt % vanadium. In another specification of this alloy composition, the aluminum alloy contains the electrodes titanium, zirconium, scandium and vanadium in the following amounts:

0.12 to 0.15 wt % titanium (Ti),
0.14 to 0.16 wt % zirconium (Zr),
0.13 to 0.17 wt % scandium (Sc) and
0.12 to 0.15 wt % vanadium (V).

Another improvement of the discussed properties of a semi-finished part or product produced from such an alloy can be achieved if the sum of the elements zirconium, titanium, scandium and vanadium is less than or equal to 0.4 wt %, and in particular less than or equal to 0.35 wt %.

The aluminum alloy preferably contains zirconium with amounts between 0.03 and 0.15 wt %. Titanium is preferably contained in the alloy with amounts between 0.03 and 0.09 wt %.

It is advantageous if the iron content of the alloy is limited to a max. of 0.09 wt %.

The special properties of the claimed Al—Cu—Mg—Ag alloy also appear if it has a reduced amount of dispersoid producers. This is present, for example, if the claimed alloy comprises the following amounts of the elements titanium, zirconium, scandium and vanadium:

0.04 to 0.06 wt % titanium (Ti),
0.05 to 0.07 wt % zirconium (Zr),
0.08 to 0.10 wt % scandium (Sc) and
0.10 to 0.12 wt % vanadium (V).

The aluminum alloy preferably contains 0.3 to 0.6 wt % silver.

Silicon preferably participates in the buildup of the alloy properties between 0.3 and 0.6 wt %.

The manganese content of the aluminum alloy is preferably set at 0.1 to 0.3 wt %.

Another improvement of the special static and dynamic strength properties as well as of the creep resistance can be achieved if the content of the elements silicon, copper, manganese, magnesium and silver of the aluminum alloy is limited as follows:

0.45-0.55 wt % silicon (Si)
4.10-4.30 wt % copper (Cu)
0.15-0.25 wt % manganese (Mn)
0.5-0.7 wt % magnesium (Mg) and
0.40-0.55 wt % silver (Ag).

Investigations have shown that the alloy, and the semi-finished parts or products produced from it, have an especially good creep resistance if the sum of the elements silver, zirconium, scandium and vanadium is at least 0.60 wt % and maximally 1.1 wt %.

It is advantageous if the elements silver and scandium are contained in the alloy in amounts such that the ratio of the amount of silver to scandium is between 5 and 23, and preferably between 9 and 14.

The amounts of the elements scandium and zirconium are advantageously contained in the alloy in a ratio of scandium to zirconium between 1 and 17, and preferably between 6 and 12.

In regard to amount of the elements silver and vanadium, a ratio of silver to vanadium between 0.5 and 14 is considered to be especially desirable, and in particular a ratio between 5 and 9.

Semi-finished parts or products are typically produced from the disclosed heat-resistant aluminum alloy by the following steps:

(a) Casting of a bar from the alloy with sufficient dissolution of the electrodes zirconium, scandium and vanadium, (b) Homogenization of the cast bar at a temperature that is as close as possible below the melting temperature of the alloy for a time that is sufficient to achieve the most uniform distribution possible of the alloy elements in the cast structure, preferably at 485 to 510° C. for a period of 10 to 25 hour, (c) Thermal deformation of the homogenized bar by extruding, forging (including reverse extrusion molding) and/or rolling in the temperature range of 280 to 470° C., (d) Solution annealing of the extruded, forged and/or rolled semi-finished part at temperatures that are high enough to bring the alloy elements necessary for the hardening into solution distributed in the structure, preferably at 480 to 510° C. over a time of 30 min to 8 h, (e) Quenching the solution-annealed semi-finished part in water with a temperature between room temperature and 100° C. (boiling water) or in water-glycol mixtures with temperatures ≤50° C. and glycol contents of up to 60%, (f) Selective cold deformation of the quenched semi-finished part by upsetting or stretching by an amount that results in a reduction of the intrinsic tensions produced during the quenching in cool quenching medium, preferably by 1-5%, and (g) Thermal hardening of the semi-finished part quenched in this manner and selectively cold-upset or stretched at temperatures adapted to the planned usage, preferably between 80 and 210° C. over a time of 5 to 35 h, preferably 10 to 25 h in a 1-, 2- or 3-stage process.

A sufficient dissolution of the electrodes zirconium, scandium and vanadium can therefore be achieved by moving the melt during the melting of the alloy (i.e. the molten aluminium alloy) before the casting step and during the casting of a bar. It is especially advantageous if the melt is moved by convection. Such a convection can be produced by external magnetic influences, as for example in an induction furnace. Therefore, the aluminum alloy is preferably melted in an induction furnace.

BRIEF DESCRIPTION OF THE DRAWINGS

The invention is described using exemplary embodiments and by comparison to previously known aluminum alloys, with reference made to the attached figures. In the figures:

FIG. 1: shows a diagram with the chemical composition of the claimed alloy in comparison to the chemical compositions of previously known aluminum alloys.

DETAILED DESCRIPTION

Figure 2:
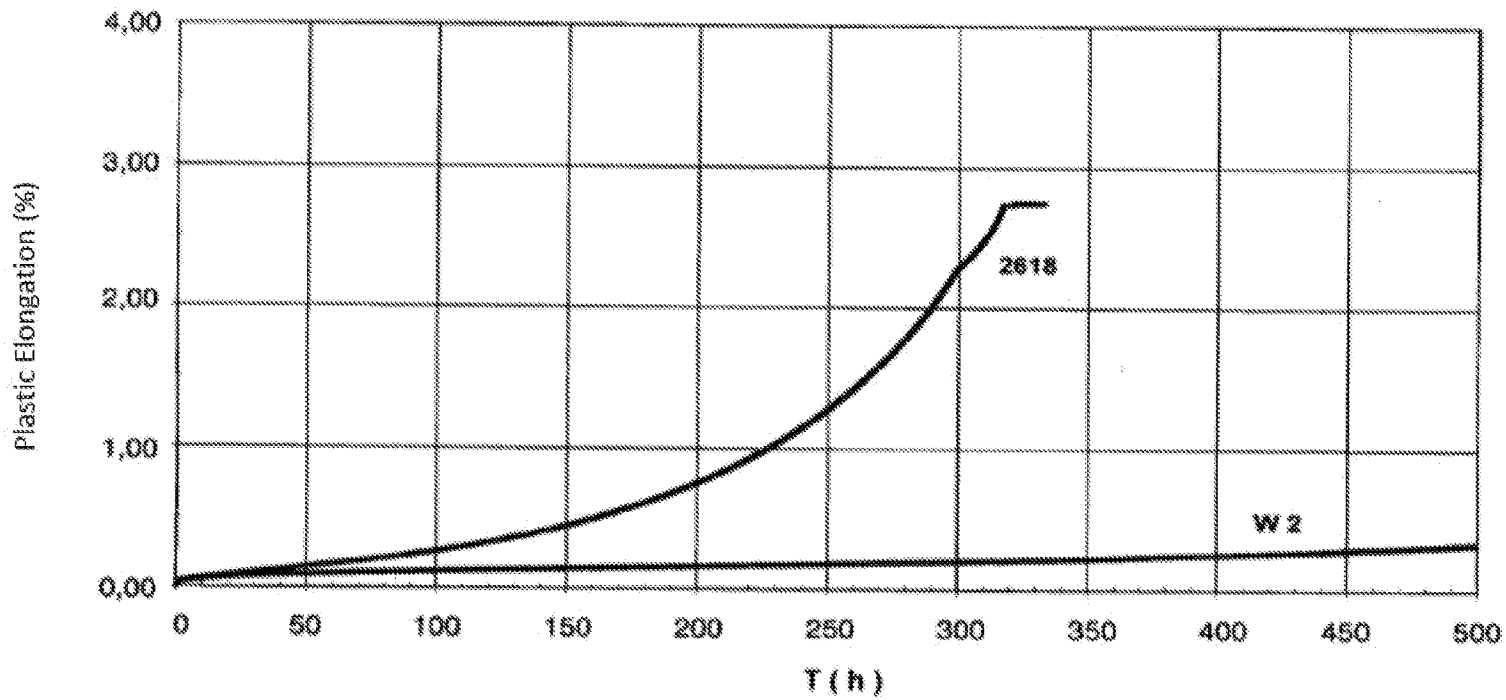
FIG. 2: shows a comparison of the creep properties of the claimed alloy with a previously known alloy considered to be especially creep-resistant.

FIG. 1 shows a comparison of the chemical composition of the claimed alloy with previously known aluminum alloys. These alloys include those from which semi-finished parts or products with high static and dynamic strength properties can be produced in a known manner, and specifically AA2014, AA2014A and AA2214. In addition, two known alloys associated with an especially good long-time stability under thermal influences are provided, namely AA2618 and AA2618A. The known alloy AA2016 is also given. The data in the table for the amounts of the particular alloy elements is taken from the International Alloy Designations and Chemical Composition Limits for Wrought Aluminum and Wrought Aluminum Alloys, The Aluminum Association Inc., 1525 Wilson Boulevard, Arlington, April 2006.

The table of FIG. 1 indicates the disclosed alloy according to the invention with a "W" designation. Comparison of the alloy compositions clearly demonstrates the differences of the claimed heat-resistant aluminum alloy, specifically by the addition of the elements vanadium and scandium and the special selection of the remaining alloy components including its particular amount. It is also clear from this comparison that the claimed alloy W cannot be derived as the sum or in some other manner from these previously-known alloys.

Two typical alloy compositions of the claimed alloy were produced and investigated for the production of test pieces and for carrying out investigations of strength at room temperature and an elevated temperature. The two alloys W1 and W2 had the following chemical composition:

| Element | W1 wt % | W2 wt % |
|---|---|---|
| Si | 0.51 | 0.50 |
| Fe | 0.092 | 0.084 |
| Cu | 4.06 | 4.22 |
| Mn | 0.186 | 0.207 |
| Mg | 0.591 | 0.586 |
| Cr | 0.009 | 0.013 |
| Ni | 0.002 | 0.009 |
| Zn | 0.009 | 0.007 |
| Ti | 0.128 | 0.059 |
| Zr | 0.146 | 0.059 |
| V | 0.131 | 0.115 |
| Sc | 0.137 | 0.089 |
| Ag | 0.46 | 0.49 |
| Others individually | 0.05 | 0.05 |
| Others total | 0.15 | 0.15 |
| Al | Remainder | Remainder |

Furthermore, test pieces of the comparison alloys AA2016 and AA2618 were produced and correspondingly investigated. For the theoretical composition of these alloys, see the data in FIG. 1.

In order to determine the strength properties, the alloys W1 and W2 were cast on an industrial scale to cast extrusion blocks with a diameter of 370 mm, whereby care was taken that the elements zirconium, scandium and vanadium were sufficiently dissolved during the casting of the bars. To this end, the molten aluminum alloy or melt was put in motion by generating a convection in the melt. The cast extrusion blocks were homogenized in order to compensate the crystal segregations conditioned by the hardening. The blocks were homogenized and cooled off in two stages using a temperature range of 500° C. to 550° C. After twisting off the casting skin, the homogenized blocks were preheated to approximately 400° C. and multiply deformed to free-form forged pieces with a thickness of 100 mm and a width of 250 mm. Subsequently, the free-form forged pieces from alloys W1 and W2 were solution-annealed for at least 2 h at 500° C., quenched in water, and subsequently hot-hardened between 165° C. and 200° C. Tensile tests were taken from the hot-hardened free-form forged pieces on which the strength properties were determined at room temperature in the longitudinal (L) test position. The results are listed in the table below:

| Alloy | $R_{p0.2}$ [MPa] | $R_m$ [MPa] | $A_5$ [%] |
|---|---|---|---|
| 2016 | 446 | 490 | 11.1 |
| 2618 | 344 | 432 | 10.4 |
| W1 | 399 | 449 | 8.1 |
| W2 | 383 | 437 | 10.6 |

For purposes of a comparison, the strength properties for free-form forged pieces of the alloys AA2016, followed by W1, W2 and AA2618 in the heat-hardened state are additionally indicated in the table.

The alloy AA2016 shows the greatest strength (stretch limit), followed by W1, W2 and AA2618. A sufficient ductility of >8% is achieved by all alloys. It should be noted at this point that the strength values of the comparison alloy AA2016 were not able to be reached with the test alloys W1, W2. However, the test values achieved clearly exceed those of the other comparison alloy AA2618. For the cases of use in question, the strength values that the test alloys W1, W2 have are sufficient. It is important that the test alloys W1, W2 have a significantly better creep resistance, as described in the following with reference to FIG. 2, in comparison to the comparison alloy AA2618 which is considered to be creep-resistant.

The differences are especially noticeable in a comparison of the creep behavior of the alloy AA2618, known as creep-resistant, with the alloy W2. This comparison is shown in FIG. 2. The diagram of FIG. 2 shows the creep properties of the respective alloys at 190° C. and a creep tension of 200 MPa. While the alloy AA2618 is known as especially creep-resistant and has previously been used for such purposes, breaks after about 320 hours in the prescribed test setup and a plastic expansion of about 1% at about 230 hours were experienced. The examined time period of 500 h was not sufficient to cause the test alloy W2 to break. At the same time of the break of the test piece for alloy AA2618, a plastic deformation of only about 0.2% was able to be determined for the test alloy W2. The improved creep resistance of the claimed alloy in comparison to the alloy AA2618 (considered to be especially creep-resistant) is surprising.

The test pieces of the other test alloy W1 have a creep resistance that corresponds to the one shown in the diagram of FIG. 2 for the test alloy W2.

Figure 3:
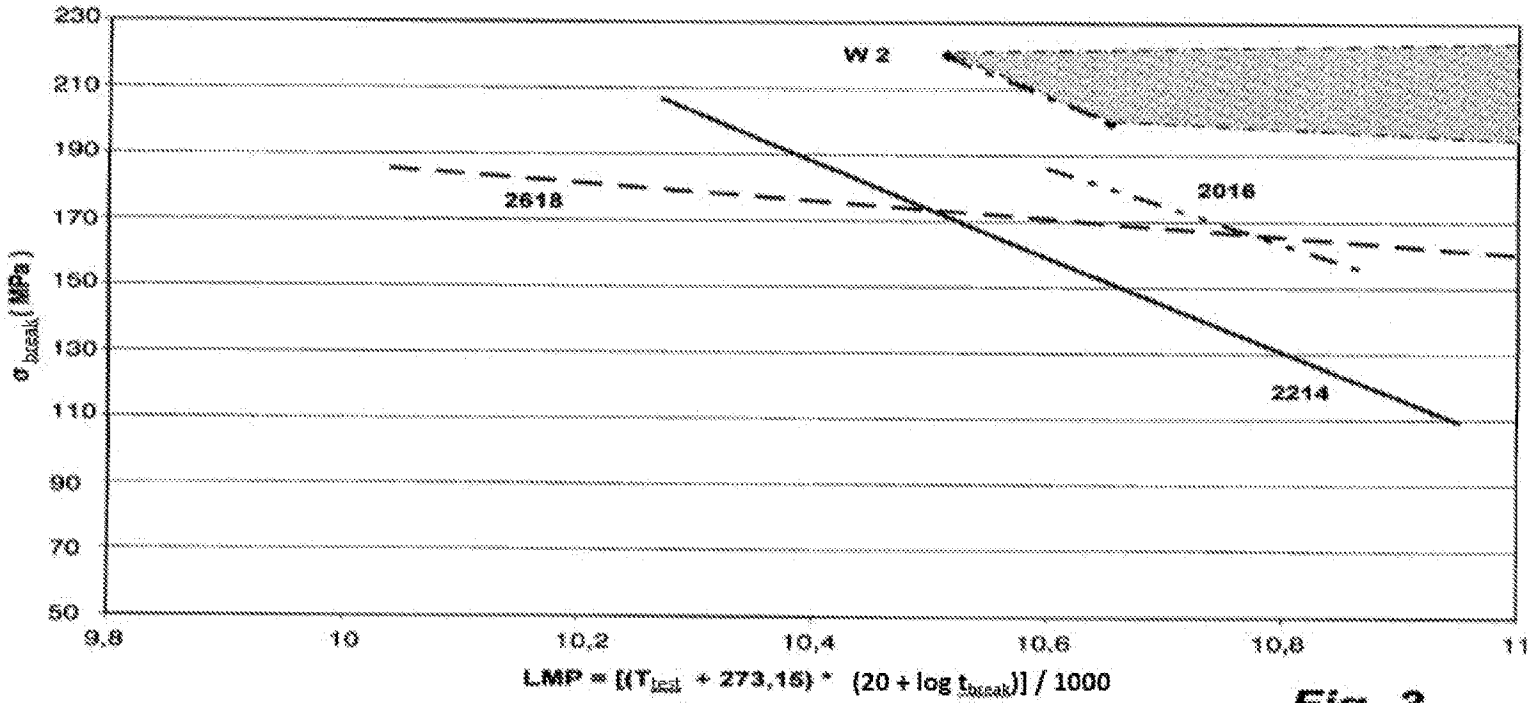
FIG. 3: shows a Larsen-Miller diagram for representing the creep behavior of the claimed alloy in comparison to previously known ones.

The special properties of the claimed alloy are also evident by a comparison of this alloy and of the two test alloys W1, W2 with known alloys in a Larsen-Miller diagram. FIG. 3 shows such a diagram. In this representation, the strength properties are shown linked with a temperature resistance. The alloy AA2618, known as especially creep-resistant, is distinguished by a relatively slight inclination of its break line. The alloy AA2014 on the other hand, which meets the high static and dynamic requirements, has a distinctly steeper angle of inclination of its break line. The curves of these two alloys intersect. That means that in the test structure documented in the diagram, the alloy AA2214 first resists higher tensions, namely in the curve section located above the curve of the alloy AA2618, and then decreases much more rapidly with increasing temperature and/or time in regard to its breaking tension than the alloy AA2618. The alloy AA2016 is also entered in this diagram for comparison. Since this curve is located to the right of the curve of the alloy AA2014, it is clear that it is more long-time resistant in comparison to the alloy AA2014. It also becomes clear that the alloy AA2016 requires a higher tension up to a certain point in time in order to bring about a break.

These curves of previously-known aluminum alloys are opposed by the area of the Larsen-Miller diagram in which the values of semi-finished parts or products produced with the claimed alloy are located. The line of the test pieces of the test alloys W1, W2 are concretely entered, whereby it is to be taken into consideration that this line does not represent the break line, but rather the state of the test samples after a test time of 500 hours. A break did not occur within this time frame (see also FIG. 2 in this regard by way of comparison). Therefore, the sketched-in lines are considered to be minimum lines with respect to the test alloys W1, W2. The actual break lines of the test alloys W1, W2 are located much further to the right in the Larsen-Miller diagram. Even the inclination of these two curves should probably be significantly smaller than it is sketched in. For this reason, the representation of a field was selected in order to be able to compare the improved properties of the claimed alloy with the properties of the known alloys discussed. The improved creep behavior of the claimed alloy can be clearly gathered from the Larsen-Miller diagram of FIG. 3.

The invention claimed is:

1. A semi-finished part or semi-finished product produced from a heat-resistant Al—Cu—Mg—Ag alloy, suitable for use at high temperatures and with high static and dynamic strength properties combined with an improved creep resistance, characterized in that:

the aluminum alloy comprises 0.45-0.55 wt % silicon (Si)
max. 0.15 wt % iron (Fe)
4.1-4.7 wt % copper (Cu)
0.05-0.5 wt % manganese (Mn)
0.3-0.9 wt % magnesium (Mg)
0.02-0.15 wt % titanium (Ti)
0.05-0.07 wt % zirconium (Zr)
0.1-0.7 wt % silver (Ag)
0.03-0.5 wt % scandium (Sc)
0.03-0.2 wt % vanadium (V)
max. 0.05 wt % others, individually
max. 0.15 wt % others, total
remainder aluminum; and the semi-finished part or product can endure a creep test conducted at a temperature of 190° C. and a creep tension of 200 MPa for 500 hours or more without breaking.

2. The part or product of claim 1, wherein the sum of the elements zirconium, titanium, scandium and vanadium is less than or equal to 0.4 wt %.

3. The part or product of claim 1, wherein the aluminum alloy contains:

0.04 to 0.06 wt % titanium (Ti),
0.08 to 0.10 wt % scandium (Sc) and
0.10 to 0.12 wt % vanadium (V).

4. The part or product of claim 1, wherein the aluminum alloy contains:

4.10-4.30 wt % copper (Cu)
0.15-0.25 wt % manganese (Mn)
0.5-0.7 wt % magnesium (Mg) and
0.40-0.55 wt % silver (Ag).

5. The part or product of claim 1, wherein the sum of the elements silver, zirconium, scandium and vanadium is at least 0.60 wt % and maximally 1.1 wt %.

6. The part or product of claim 1, wherein the aluminum alloy contains the elements silver and scandium in a ratio of Ag:Sc=5-23.

7. The part or product of claim 1, wherein the aluminum alloy contains the elements scandium and zirconium in a ratio of Sc:Zr=1-17.

8. The part or product of claim 1, wherein the aluminum alloy contains the elements silver and vanadium in a ratio of Ag:V=0.5-14.

9. The part or product of claim 1, wherein the aluminum alloy contains an iron content of max. 0.09 wt %.

* * * * *